US005083894A

United States Patent [19]

Ikari et al.

[11] Patent Number: 5,083,894

[45] Date of Patent: Jan. 28, 1992

[54] APPARATUS FOR MAINTAINING ATTITUDE OF BUCKET CARRIED BY LOADING/UNLOADING VEHICLE

[75] Inventors: Masanori Ikari, Sayama; Masao Fukuda, Kawagoe, both of Japan

[73] Assignee: Kabushiki Kaisha Komatsu Seisakusho, Japan

[21] Appl. No.: 415,260

[22] PCT Filed: Jan. 18, 1989

[86] PCT No.: PCT/JP89/00036

§ 371 Date: Sep. 14, 1989

§ 102(e) Date: Sep. 14, 1989

[87] PCT Pub. No.: WO89/06723

PCT Pub. Date: Jul. 27, 1989

[30] Foreign Application Priority Data

Jan. 18, 1988 [JP] Japan ..... 63-6837

[51] Int. Cl.[5] ..... E02F 3/43

[52] U.S. Cl. ..... 414/700; 414/701; 414/708

[58] Field of Search ..... 414/699, 700, 701, 706, 414/708

[56] References Cited

U.S. PATENT DOCUMENTS 3,547,293 12/1970 Borer et al. ..... 414/701 X
3,659,734 5/1972 Fuzzell ..... 414/701
4,037,519 7/1977 Miller et al. ..... 414/701
4,377,043 3/1983 Inui et al. ..... 414/699 X
4,844,685 7/1989 Sagaser ..... 414/700
4,923,362 5/1990 Fryk ..... 414/708 X

FOREIGN PATENT DOCUMENTS 0258819 3/1988 European Pat. Off. .
148728 7/1987 Japan ..... 414/699

OTHER PUBLICATIONS

Patent Abstracts of Japan, vol. 9, No. 268 (M-424) (1991), 10/25/85, JPA-60 112 936 (Komatsu Seisakusho KK) 19-06-1985 & Abstract.

*Primary Examiner*—Robert J. Spar
*Assistant Examiner*—William M. Hienz
*Attorney, Agent, or Firm*—Handal & Morofsky

[57] ABSTRACT

A loading/unloading vehicle having booms and a bucket carried thereon such as a shovel loader, a wheel loader or the like vehicle detects that a true bucket-to-ground angle coincides with a preset angle after the vehicle starts automatic turning movement of the bucket. When the coincidence is detected, the automatic turning movement of the bucket is interrupted. Thereafter, a differential value between the true bucket-to-ground angle and the preset angle is determined, if any and then the bucket angle is corrected so as to allow the differential value to be reduced to zero. Consequently, the bucket is held at the preset angle after the bucket stops, even though the booms continue to be turned.

3 Claims, 10 Drawing Sheets

APPARATUS FOR MAINTAINING ATTITUDE OF BUCKET CARRIED BY LOADING/UNLOADING VEHICLE

TECHNICAL FIELD

The present invention relates generally to an apparatus for maintaining the attitude of a bucket, fork or the like secured to booms at a predetermined angle inclusive a horizontal plane, wherein the apparatus is installed on a working machine in the form of a loading-/unloading vehicle having booms and a bucket or booms and a fork carried thereon such as a shovel loader, wheel loader or the like vehicle.

BACKGROUND ART

Since a working machine in the form of a loading/unloading vehicle having booms supporting a load carrier, for example a bucket or a fork carried thereon such as a wheel loader, shovel loader or the like has advantageous features that it is designed and constructed in smaller dimensions, it can turn with a small radius and it can be purchased at an inexpensive cost, it has been widely utilized in many field sites of civil engineering works.

As shown in FIG. 9, this kind of loading/unloading vehicle is so constructed that booms 1 are vertically turned by means of a boom cylinder 3 (rising of the booms 1 being referred to as "lift") and a bucket 2 is turned to the tilt side (representing turning movement of the bucket to the vehicle body side (excavating side)) or to the dump side (representing reverse operation to the tilting operation, i.e., turning movement of the bucket to the gravel dump side). Thus, as the booms 1 and the bucket 2 are turned in that way, gravel or the like is excavated (scooped), loaded or dumped.

To assure that a next gravel scooping operation is performed at a high efficiency after gravel is loaded on a dump truck or dumped in a hopper by operating a shovel loader or the like working machine, it is required that during rearward movement of the vehicle, the booms 1 are lowered while correcting an angle of the bucket 2 from the downward attitude so as to allow the bottom surface 2*a* of the bucket 2 to extend horizontally (representing turning movement of the bucket 2 to the tilt side). To meet this requirement, an operator is required to visually confirm rearward movement of the vehicle as well as operation in the front area so as to allow the bottom surface 2*a* of the bucket 2 to horizontally extend on the ground surface, as represented by solid lines in FIG. 9. Accordingly, he is required to perform a steering operation by turning a handle as well as a lever actuation for turning the bucket 2 to the tilt side or stopping it. However, to perform these operations, a highly skilled technique is required. Further, since such operation for causing the bottom surface 2*a* of the bucket 2 to extend horizontally is manually performed by his visual confirmation, a scooping operation to be performed during a next cycle is accomplished at a low efficiency.

To solve the foregoing problem, a bucket leveler mechanism has been heretofore used. The bucket leveler mechanism essentially comprises a lever detent mechanism for immovably holding a bucket actuating lever at a full stroke position on the tilt side, a solenoid for releasing a lever detent in the lever detent mechanism from the immovable state and permitting the bucket actuating lever to be restored from the full stroke position to a neutral position and a proximity switch LS for detecting that the bucket cylinder 4 expands to a predetermined cylinder length with which the bottom surface 2*a* of the bucket 2 extends horizontally (see FIG. 10).

With such bucket leveler mechanism, when the bucket actuating lever is actuated to the full stroke position on the tilt side during rearward movement of the vehicle after gravel is loaded or dumped, it is immovably held by the lever detent .mechanism, whereby the bucket 2 automatically continues to turn to the tilt side from the position where it assumes a downward attitude, even though an operator's hand is released from the bucket actuating lever. When the bucket cylinder 4 expands to a predetermined cylinder length during turning movement of the bucket 2 and thereby the proximity switch LS is actuated, this cylinder length is detected by the proximity switch LS which in turn outputs a detection signal to activate the solenoid. Consequently, the bucket actuating lever which has been immovably held at the full stroke position on the tilt side is automatically restored to the neutral position, whereby turning movement of the bucket to the tilt side is interrupted with the result that the bucket 2 is automatically stopped at a predetermined angle which is determined such that the bottom surface 2*a* of the bucket 2 extends horizontally. With such bucket leveler mechanism, an operator can concentrate his attention on a lowering operation of the booms 1 as well as a steering operation for the vehicle. In addition, he can concentrate his visual confirmation on rearward movement of the vehicle, resulting in an increased operational efficiency and an improved safety being assured.

With respect to the conventional bucket leveler mechanism as constructed in the above-described manner, however, since arrangement of the proximity switch LS is made such that the bottom surface 2*a* of the bucket 2 extends horizontally when the booms 1 are lowered to the predetermined position where the bottom surface 2*a* of the bucket 2 comes in contact with the ground surface, it has been found that a working machine such as a shovel loader or the like including a link mechanism comprising booms 1 and a bucket 2 fails to operate such that the bottom surface 2*a* of the bucket 2 extends horizontally in response to actuation of the bucket leveler mechanism, when the booms 1 are held at a position other than the predetermined lowered position where the bottom surface 2*a* of the bucket 2 comes in contact with the ground surface.

Accordingly, while the conventional bucket leveler mechanism is employed for the vehicle, there arise the following problems, particularly when the bucket 2 is raised up to an elevated position above the ground surface, as represented by two-dot chain lines in FIG. 9.

(1) When an operation for uniformly leveling the upper surface of gravel or the like material (hereinafter referred to as a leveling operation) is performed after a damp truck is fully loaded with gravel or the like material using a shovel loader or the like working machine, the bottom surface of the bucket does not extend horizontally while the bucket is held immovable with the conventional bucket leveler mechanism, because the bucket is normally maintained at a high position during the leveling operation. Thus, an operator is required to visually perform a correcting operation for tilting the bucket to a horizontal attitude.

(2) When a loading/unloading operation is performed using a fork FK as shown in FIG. 11 in place of the bucket, it is required that an edge of the fork FK is horizontally oriented without fail prior to loading of a cargo on the fork FK. However, when the cargo is placed on the fork FK held at a high position using the conventional bucket leveler mechanism, the fork edge fails to extend horizontally like the preceding case where the bucket is used. Therefore, he is required to visually performing a correcting operation in the same manner as mentioned above. Thereafter, as the fork FK having the cargo loaded thereon is lowered to the ground surface, the fork edge is inclined downward (forward) due to characteristics of the link mechanism and this gives rise to a danger that the cargo falls down. Accordingly, when the conventional bucket leveler mechanism is employed for the vehicle, he is required to actuate it during lowering movement of the fork so as to allow the fork edge to maintain its horizontal attitude throughout the lowering movement of the fork.

Since the conventional bucket leveler mechanism is so constructed that the bucket can keep its excavating-/loading attitude only when it is held at a position in the proximity of the ground surface, an angle of the bottom surface of the bucket varies as a height of the bucket varies. Thus, the conventional bucket leveler mechanism has significant problems that a loading operation to be performed using a bucket, fork or the like means is very troublesome for an operator, he becomes tired and the loading operation is performed at a low efficiency, because he is required to change an angle of the bucket while visually monitoring the loading operation or he is required to change an angle of the fork in the course of raising/lowering of the booms.

The present invention has been made with the foregoing background in mind and its object resides in providing an apparatus for maintaining the attitude of a bucket carried by a loading/unloading vehicle which assures that the bucket can be held at a certain preset angle irrespective of how far a height of booms is varied.

DISCLOSURE OF THE INVENTION

To accomplish the above object, the present invention provides an apparatus for maintaining the attitude of a bucket carried on a loading/unloading vehicle, wherein the apparatus comprises booms adapted to turn about a fulcrum on a vehicle body, the bucket being turnable about fore ends of the bucket, boom angle detecting means for detecting an angle assumed by the booms, bucket angle detecting means for detecting an angle assumed by the bucket, bucket-to-ground angle calculating means for calculating an angle of the bucket relative to a horizontal plane based on outputs from the boom angle detecting means and the bucket angle detecting means, presetting means for presetting an angle at which the bucket is held immovable, lever detent means for immovably holding a bucket actuating lever at a predetermined full stroke position, releasing means for releasing the immovable state of the bucket actuating lever provided by the lever detent means and then restoring the bucket actuating lever to a neutral position, coincidence detecting means for detecting a coincidence of a value calculated by the bucket-to-ground angle calculating means with an angle preset by the presetting means by comparing the calculated value with the preset angle after the lever detent means is actuated, controlling means for determining a differential value between a value preset by the presetting means and a value calculated by the bucket-to-ground angle calculating means after the coincidence is detected by the coincidence detecting means and then providing a command of instruction a correction of the bucket angle so as to allow the differential value to be reduced to zero and driving means for turning the bucket in response to the bucket angle correcting command outputted from the controlling means with reference to displacement of the bucket actuating lever.

According to the present invention, while the bucket actuating lever is immovably held at the full stroke position by the lever detent means, the bucket is automatically turned and thereafter when a coincidence of a true bucket-to-ground angle with a certain preset angle is detected by the coincidence detecting means, the releasing means is actuated so as to allow the bucket actuating lever to be restored to the neutral position, whereby the bucket is held immovable. Thereafter, when a true bucket angle varies relative to the true bucket-to-ground angle, the bucket angle is kept unchanged at the preset angle by processing a bucket angle correcting signal corresponding to a quantity of variation, turning the bucket in accordance with the processed bucket angle correcting signal and then feeding a bucket cylinder with high pressure hydraulic oil so as to reach a target bucket angle.

With such construction, the bucket held immovable at a certain preset angle does not vary in response to turning movement of the booms and it is always held immovable at the preset angle irrespective of any angle assumed by the booms. Further, even when the bucket is raised up to an elevated height and the booms are turned by a large angle during a leveling operation after a damp truck is fully loaded with gravel or the like material, the bucket is held at the preset angle. Thus, there is no need of causing an operator to correct the bucket angle with the result that any loading/unloading operation can be performed very easily.

Since an angle of the fork edge does not vary depending upon the boom angle during an operation to be performed using a fork, he is not required to adjust the fork edge angle at any height where a cargo is placed on the fork. Thus, any loading/unloading operation can be performed with much easiness. Additionally, since the fork edge angle is kept constant during a loading/unloading operation to be performed using a fork even when the booms are raised or lowered after a cargo is placed on the fork, there is no fear that the cargo falls down and moreover the booms can be raised and lowered very safely.

BEST MODE FOR CARRYING OUT THE INVENTION

Now, the present invention will be described in detail hereinafter with reference to the accompanying drawings which illustrate preferred embodiments thereof.

Figure 1:
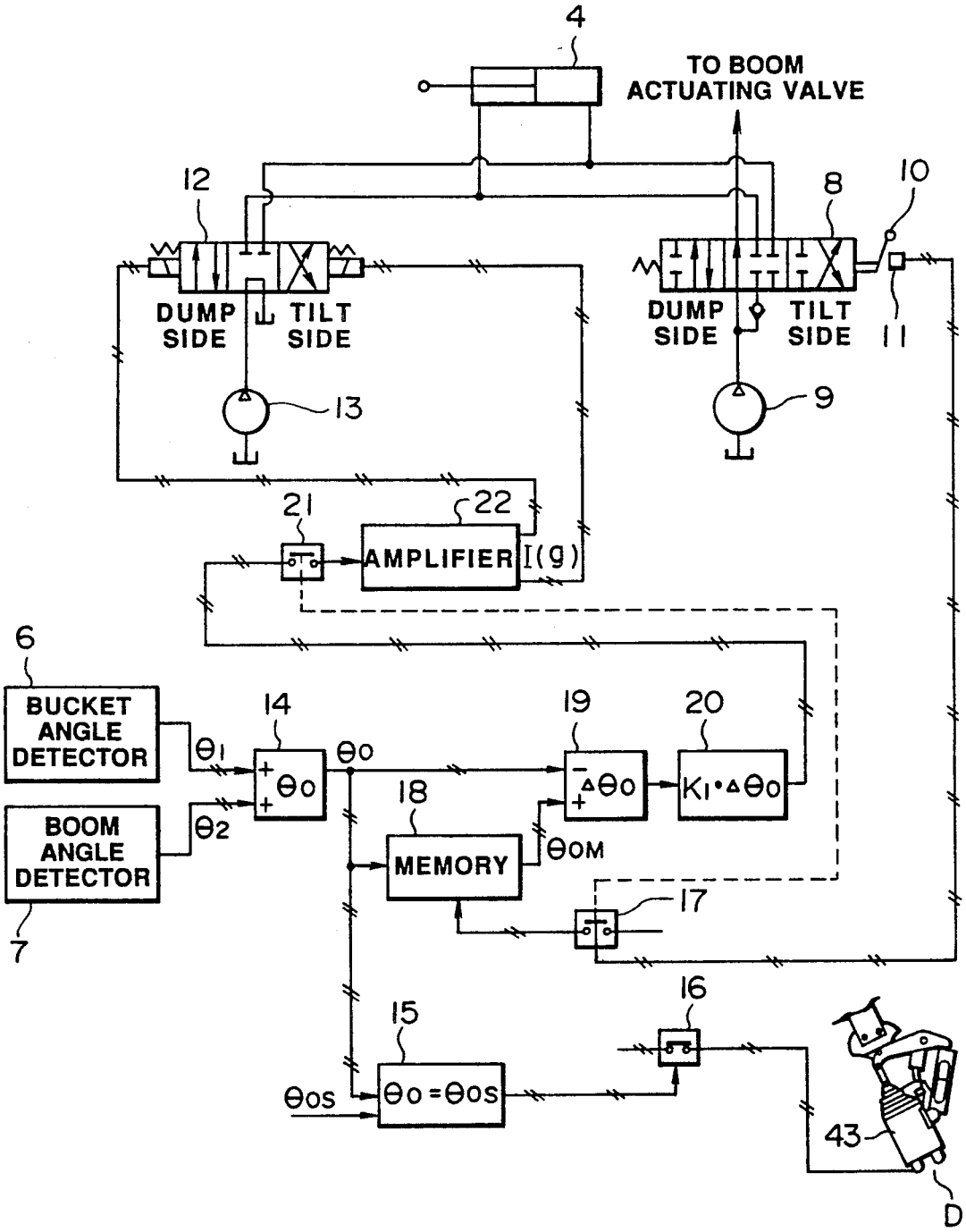
FIG. 1 is a block diagram illustrating an apparatus for maintaining the attitude of a bucket carried by a loading/unloading vehicle in accordance with an embodiment of the present invention.

FIG. 1 is a block diagram which illustrates an apparatus for maintaining the attitude of a bucket carried by a loading/unloading vehicle in accordance with a first embodiment of the present invention. Referring to FIG. 1, the apparatus includes a bucket cylinder 4 which is fed with high pressure hydraulic oil which is delivered from hydraulic pumps 9 and 13 via a bucket actuating valve 8 and a solenoid valve 12. The bucket actuating valve 8 is such that its spool position is shifted by means of a bucket actuating lever 10, whereas the solenoid valve 12 is such that its spool position is controlled in response to an electrical signal outputted from an amplifier 22.

Figure 2:
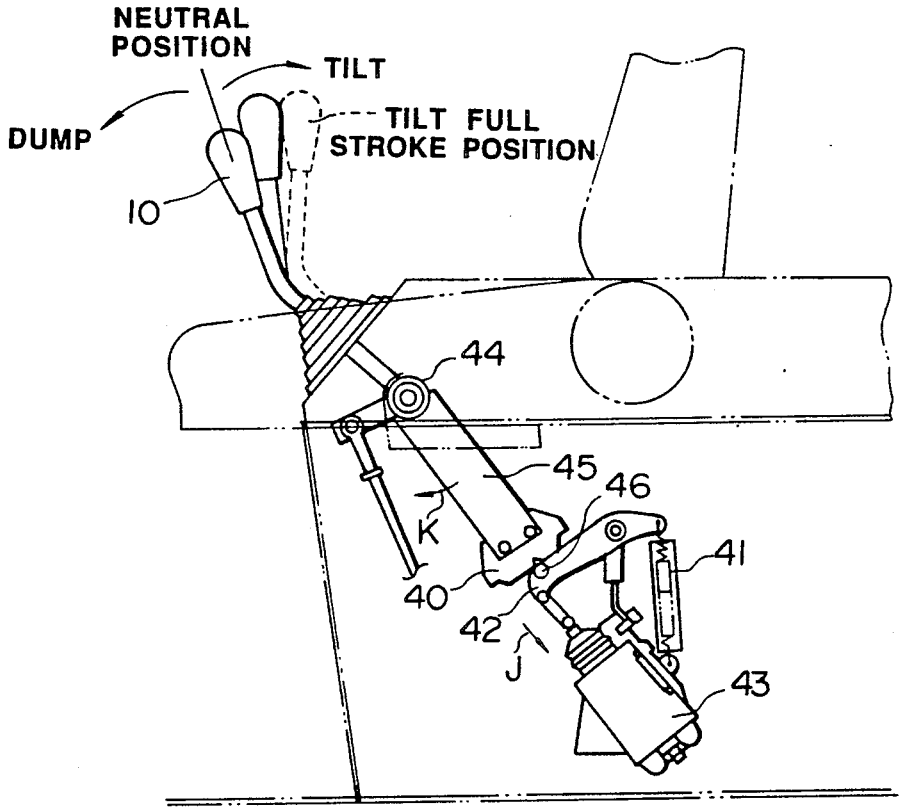
FIG. 2 is a fragmental view of the apparatus, particularly illustrating by way of example the structure of a lever detent mechanism.

In FIG. 1, reference symbol D illustrates by way of example a structure employable for bringing a detent of the bucket actuating lever 10 in the aforementioned bucket leveler mechanism in an operative state and releasing it from the operative state. FIG. 2 is a fragmental view illustrating the detailed structure of the bucket actuating lever 10 and associated components. As is apparent from FIG. 2, the bucket actuating lever 10 is constructed so as to turn about a pivotal shaft 44 either in the tilt direction or in the dump direction, and a plate 45 is connected to the pivotal shaft 44 and moreover a guide plate 40 is secured to the plate 45. As the bucket actuating lever 10 is displaced to the tilt side, the plate 45 turns about the shaft 44 in the direction of an arrow mark K. A substantially L-shaped lever member 42 is brought in pressure contact with the guide plate 40 under the effect of resilient force of a spring 41. A solenoid 43 is operatively connected to one end of the lever member 42.

Figure 3:
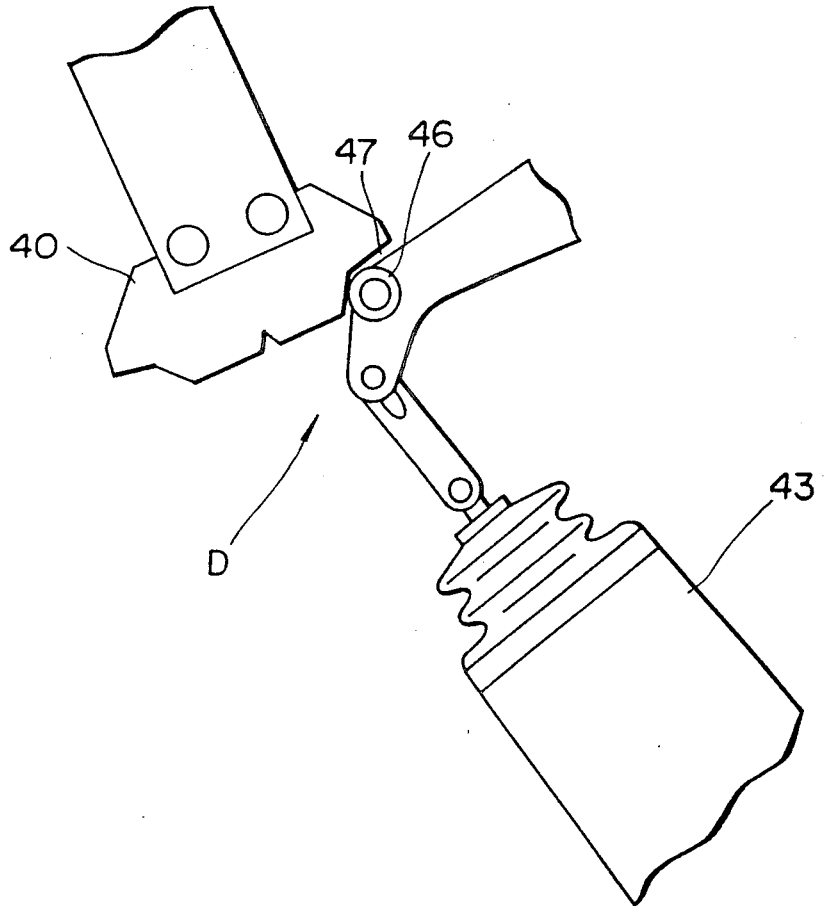
FIG. 3 is an enlarged view illustrating a part of the lever detent mechanism.

With such construction, when the bucket actuating lever 10 is displaced to a full stroke position on the tilt side as represented by dotted lines, the plate 45 and the guide plate 40 are turned in the K direction with the result that a roller 46 on the lever member 42 is fitted into a recess 47 on the guide plate 40, as shown in FIG. 3, and thereby the lever 10 is held immovable at the full stroke position. If it is required that the lever 10 is released from the immovable state, the solenoid 43 is activated to this end. Specifically, when the solenoid 43 is turned on, the lever member 42 is displaced in the direction of an arrow mark J, causing the roller 46 on the lever member 42 to be disengaged from the guide plate 40. As a result, the lever 42 is automatically restored to the neutral position as shown in FIG. 2.

Figure 9:
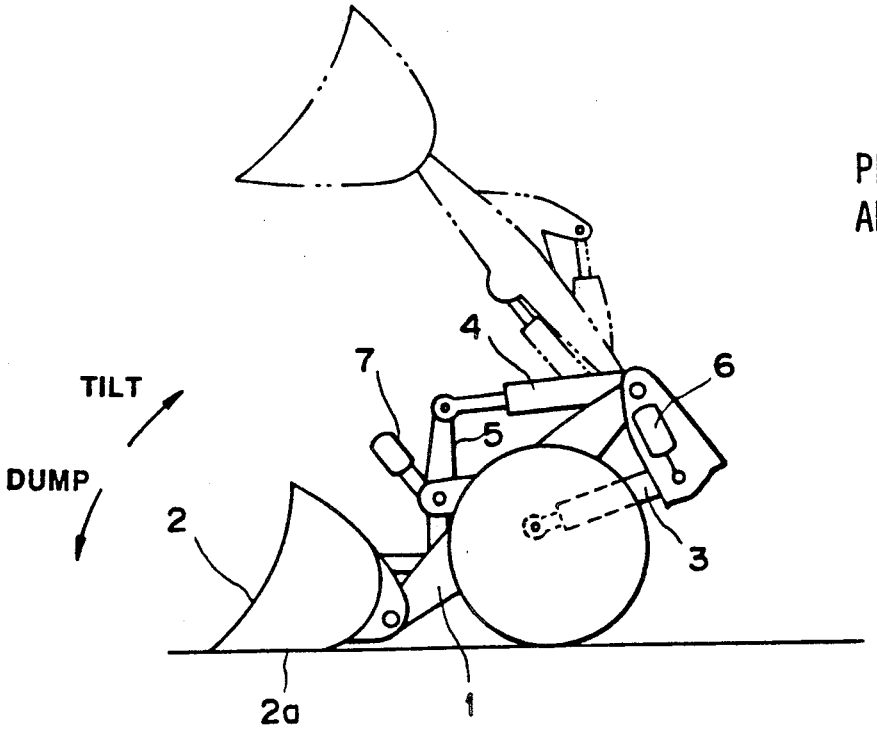
FIG. 9 is a side view showing the working portion of a shovel loader.
Figure 10:
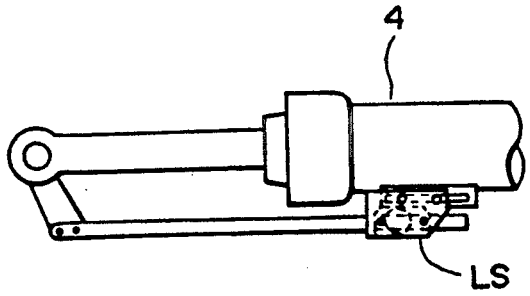
FIG. 10 is a view illustrating a conventional apparatus for maintaining the attitude of a bucket carried by a loading/unloading vehicle.
Figure 11:
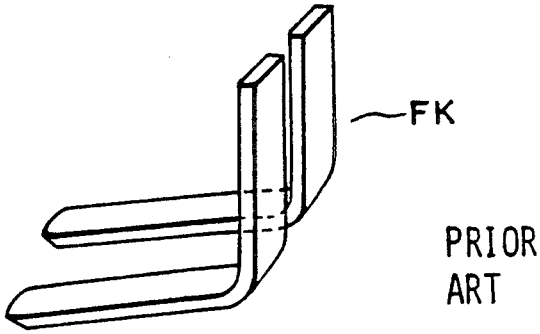
FIG. 11 is a perspective view illustrating a fork.

Referring to FIG. 1 again, a bucket angle detector 6 detects a bucket angle $\theta_1$ and a boom angle detector 7 detects a boom angle $\theta_2$. Arrangement of these detectors 6 and 7 on the vehicle is as shown in FIG. 9. The bucket angle $\theta_1$ can be detected via, e.g., a stroke of the bucket cylinder 4 or a turning angle of a bell crank 5 relative to booms 1 or a turning angle of a bucket 2 relative to the booms 1. The bucket angle indicative signal $\theta_1$ and the boom angle indicative signal $\theta_2$ are inputted into a bucket-to-ground angle calculator 14.

The bucket-to-ground angle calculator 14 calculates an angle $\theta_o$ of the bucket relative to the ground surface, e.g., by adding the bucket angle $\theta_1$ to the boom angle $\theta_2$. The bucket-to-ground angle $\theta_o$ can be represented in the form of, e.g., an angle of the bottom surface of the bucket relative to a horizontal plane.

The bucket-to-ground angle $\theta_o$ is inputted into a comparator 15. Since a preset angle $\theta_{os}$ is previously inputted into the comparator 15, the comparator 15 makes a comparison between the bucket-to-ground angle $\theta_o$ and the preset angle $\theta_{os}$ and, when it is determined that they coincide with each other, a coincidence signal is outputted from the comparator 15. Then, the coincidence signal is inputted into a switch 16, whereby its contact is turned on. Once the switch 16 is turned on, the solenoid 43 in the lever detent mechanism D is turned on. Consequently, the bucket actuating lever 10 is released from the engaged state, whereby it is restored to the neutral position.

A lever neutral position detector 11 detects that the bucket actuating lever 10 has been restored to the neutral position and its detection signal is inputted into a switch 17. When the detection signal is inputted into the switch 17 from the lever neutral position detector 11, a contact of the switch 17 is turned on. Since a switch 21 is operatively associated with the switch 17, the former is turned on when the latter is turned on.

While the switch 17 is turned on, a write enabling signal is inputted into a memory 18, whereby the output $\theta_o$ outputted from the bucket-to-ground angle calculator 14 when the bucket actuating lever 10 is restored to the neutral position is stored in the memory 18. The stored data $\theta_{oM}$ is kept in a stored state until the bucket actuating lever 10 is displaced from the neutral position. It should of course be understood that the stored data $\theta_{oM}$ represents a value substantially equal to the preset angle $\theta_{os}$.

A subtracter 19 subtracts a true bucket-to-ground angle $\theta_o$ derived from calculation in the calculator 14 from the stored data $\theta_{oM}$ in the memory 18 and the resultant differential signal $\Delta\theta_o$ $(=\theta_{oM}-\theta_o)$ is inputted into a calculator 20. To reduce the differential signal $\Delta\theta_o$ to zero, the calculator 20 calculates a bucket angle correcting signal $K_1 \cdot \Delta\theta_o$ corresponding to the differential signal $\Delta\theta_o$ and then a value derived from the calculation is inputted into an amplifier 22 via the switch 21. The switch 21 is maintained in an ON state like the switch 17, as long as the bucket actuating lever 10 is held in the neutral state. The amplifier 22 amplifies the inputted bucket angle correcting signal $K_1 \cdot \Delta\theta_o$ up to a solenoid valve actuating signal I(q) which is then inputted into the solenoid valve 12.

When the booms 1 are actuated, the bucket-to-ground angle $\theta_o$ varies due to arrangement of a link mechanism for the booms 1 and the bucket 2 in spite of the fact that the bucket 2 is held in the neutral state. Thus, while the booms 1 are actuated, the bucket cylinder 4 can be actuated with the solenoid valve 12 activated in response to the differential signal $\Delta\theta_o$, until the bucket-to-ground angle $\theta_o$ coincides with the bucket angle $\theta_{oM}$ stored in the memory 18.

Figure 4:
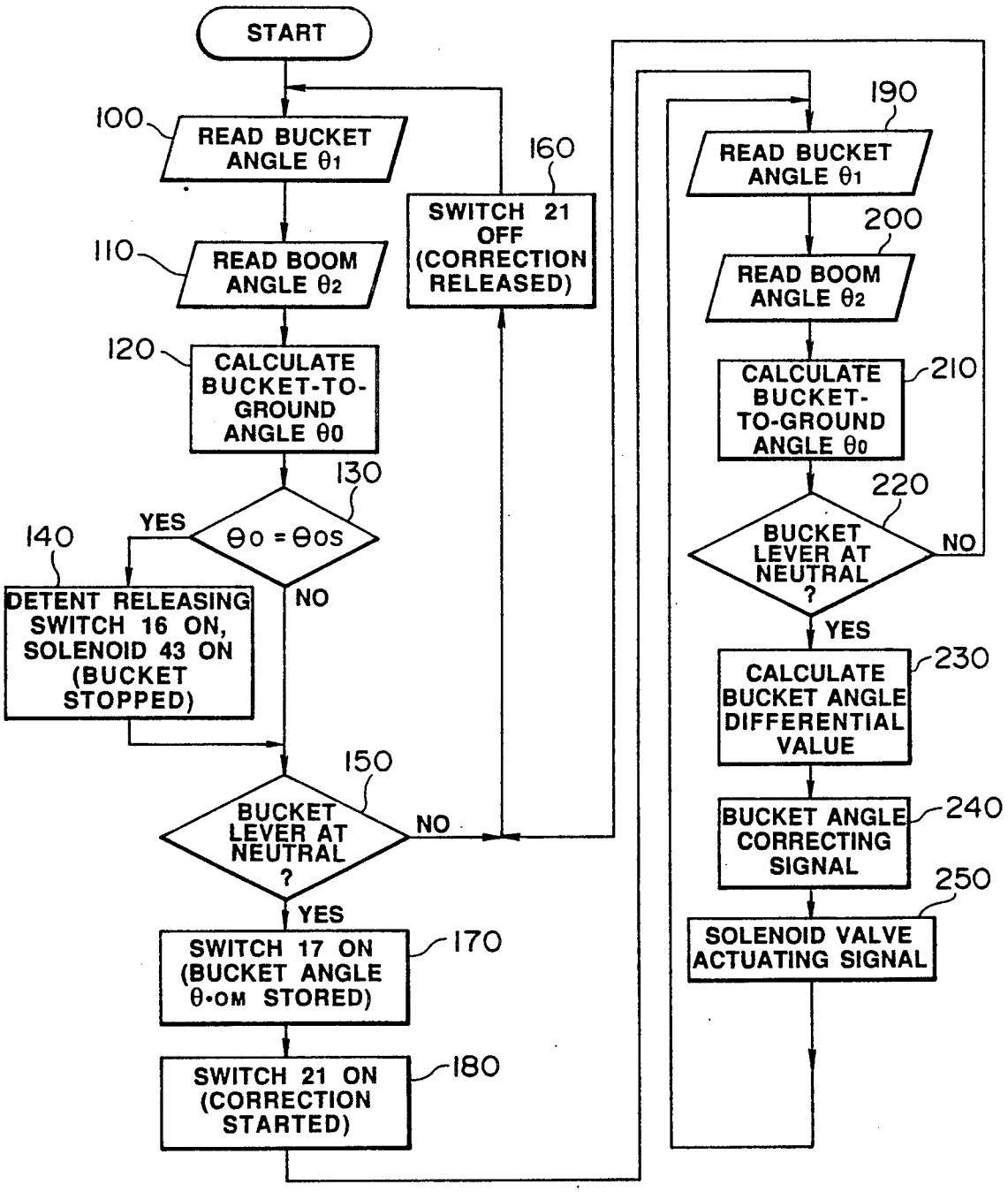
FIG. 4 is a flowchart illustrating operations of the apparatus.

Next, operation of the apparatus as constructed in accordance with the embodiment of the present invention will be described below with reference to FIG. 4 which illustrate a flowchart for the apparatus.

For example, it is assumed that an operator displaces the bucket actuating lever 10 to the full stroke position on the tilt side as represented by dotted lines in FIG. 2 to actuate the lever detent mechanism, after gravel loaded on the vehicle is dumped. At this moment, the bucket 2 is automatically tilted from its downward attitude assumed at the time of a dumping operation.

During a tilting operation, the bucket-to-ground angle calculator 14 reads a value $\theta_1$ detected by the bucket angle detector 6 and a value $\theta_2$ detected by the boom angle detector 7 so that the bucket-to-ground angle $\theta_o$ is successively calculated (steps 110 to 120). On the other hand, the comparator 15 compares the calculated value $\theta_o$ with the preset value $\theta_{os}$, and when they coincide with each other (step 130), a coincidence signal is inputted into the switch 16. This causes the switch 16 to be turned on, whereby the solenoid 43 for the lever detent mechanism D is turned on. As a result, the bucket actuating lever 10 is restored to the neutral position from the full stroke position (steps 130 and 140). Restoration of the bucket actuating lever 10 to the neutral position is detected by the lever neutral state detector 11 and this detection permits the switches 17 and 21 to be turned on (steps 150, 170 and 180). When the switch 17 is turned on, the bucket-to-ground angle $\theta_{oM}$ reached at the time when the bucket actuating lever 10 is restored to the neutral position is stored in the memory 18.

The subtracter 19 provides a differential signal $\Delta\theta_o$ between the true bucket-to-ground angle $\theta_o$ derived from the bucket-to-ground angle calculator 14 by calculation and the data $\theta_{oM}$ stored in the memory 18. The differential signal $\Delta\theta_o$ is inputted into the calculator 20 so that a bucket angle correcting signal $K_1 \cdot \Delta\theta_o$ corresponding to the differential signal $\Delta\theta_o$ is calculated in the calculator 20. When the switch 21 is turned on in response to restoration of the bucket actuating lever 10 to the neutral position, an output $K_1 \cdot \Delta\theta_o$ from the calculator 20 is inputted into the amplifier 22. The amplifier 22 amplifies the input signal $K_1 \cdot \Delta\theta_o$ up to a solenoid valve actuating signal I(q). This signal I(q) causes the solenoid valve 12 to be opened, whereby the bucket cylinder 4 is fed with high pressure hydraulic oil until the bucket-to-ground angle assumes the angle $\theta_{oM}$ stored in the memory 18. In this manner, the bucket 2 is controlled such that it is held immovable irrespective of how far the booms 1 are turned, in other words, irrespective of how high the booms 1 are raised up, and moreover the preset angle $\theta_{os}$ is maintained irrespective of how far the booms 1 are turned. Incidentally, in case where the preset angle $\theta_{os}$ is set to a degree of zero, the bucket 2 is held such that its bottom surface 2*a* assumes a horizontal attitude.

While operation of the apparatus in accordance with the illustrated embodiment has been described above with reference to FIG. 4 as to the case where the lever detent mechanism D is actuated, the structure as shown in FIG. 1 is operable even when the lever detent mechanism D is still not actuated. Namely, since the structure as shown in FIG. 1 is operable as long as the bucket actuating lever 10 is held at the neutral position, the bucket angle correcting circuit operates even when the lever detent function is not utilized, whereby the bucket is always held at the angle assumed when it is restored to the neutral state. Thus, the bucket angle is left unchanged irrespective of how far the booms are turned.

Figure 5:
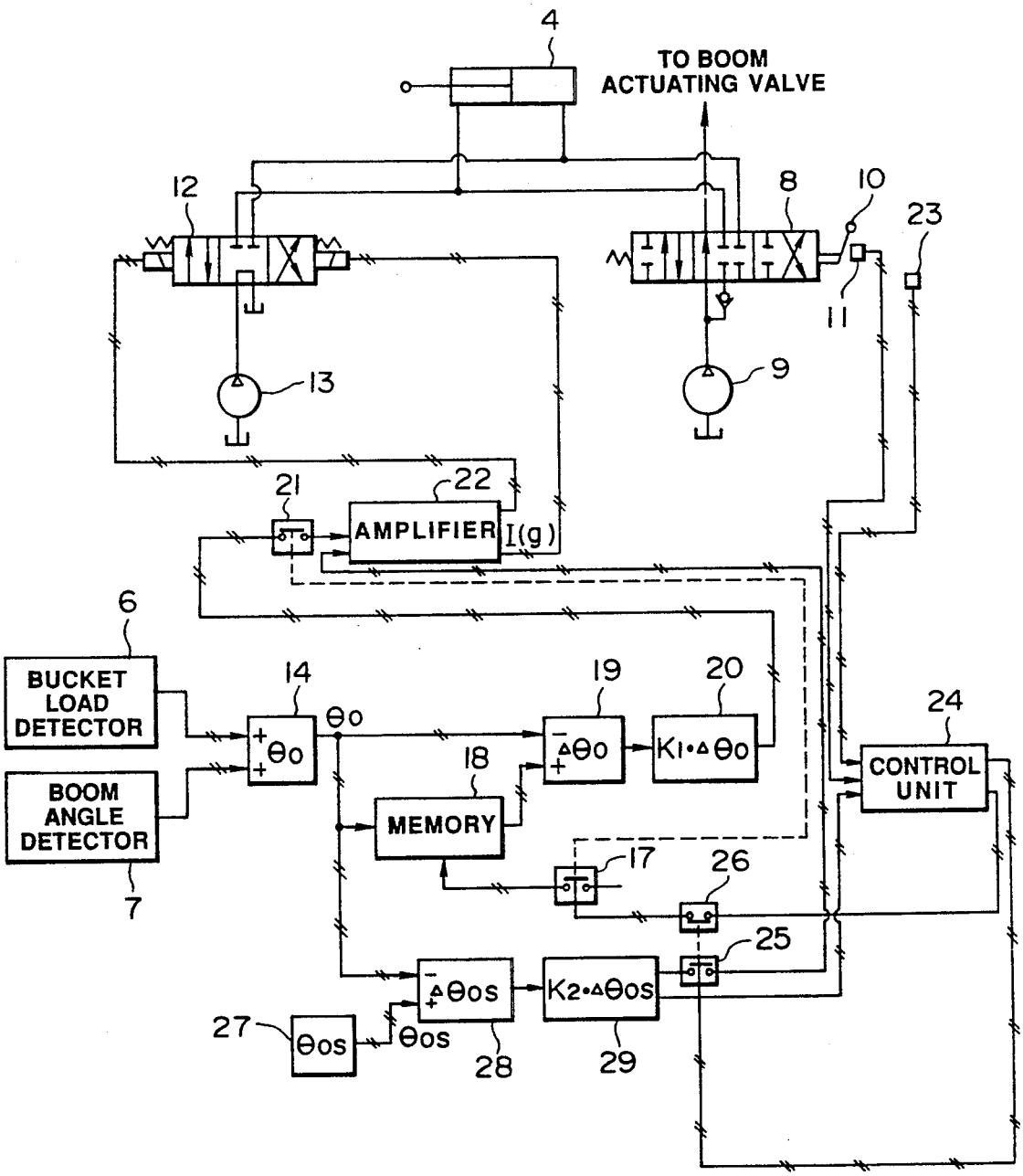
FIG. 5 is a block diagram illustrating an apparatus for maintaining the attitude of a bucket carried by a loading/unloading vehicle in accordance with other embodiment of the present invention.

Next, FIG. 5 is a schematic view similar to FIG. 1, particularly illustrating an apparatus for maintaining the attitude of a bucket for a loading/unloading vehicle in accordance with a second embodiment of the present invention.

The second embodiment is such that the lever detent mechanism D for automatically tilting the bucket 2 to a predetermined angle and then immovably holding it at the predetermined angle in accordance with the preceding embodiment is constructed in an electrical fashion. Same or similar components to those shown in FIG. 1 are represented by same reference numerals. Thus, their repeated description will not be required.

Referring to FIG. 5, a stop angle $\theta_{os}$ of the bucket 2 is preset in a setter 27. The preset angle $\theta_{os}$ and an output $\theta_o$ from the bucket-to-ground angle calculator 14 are inputted in a subtracter 28 so that the subtracter 28 obtains a differential value $\Delta\theta_{os}$ $(=\theta_{os}-\theta_o)$ between them which is then inputted into a calculator 29. The calculator 29 calculates a bucket angle correcting signal $K_2 \cdot \Delta\theta_{os}$ in correspondence to the differential signal $\Delta\theta_o$ so as to allow the inputted differential value $\Delta\theta_{os}$ to be reduced to zero. Then, the calculated value $K_2 \cdot \Delta\theta_{os}$ is inputted into the amplifier 22 via a switch 25.

The apparatus further includes a bucket leveler switch 23 which is actuated by an operator when he wants to stop the bucket 2 at the preset angle $\theta_{os}$ and the current operative state of the switch 23 is detected by a control unit 24.

Figure 6:
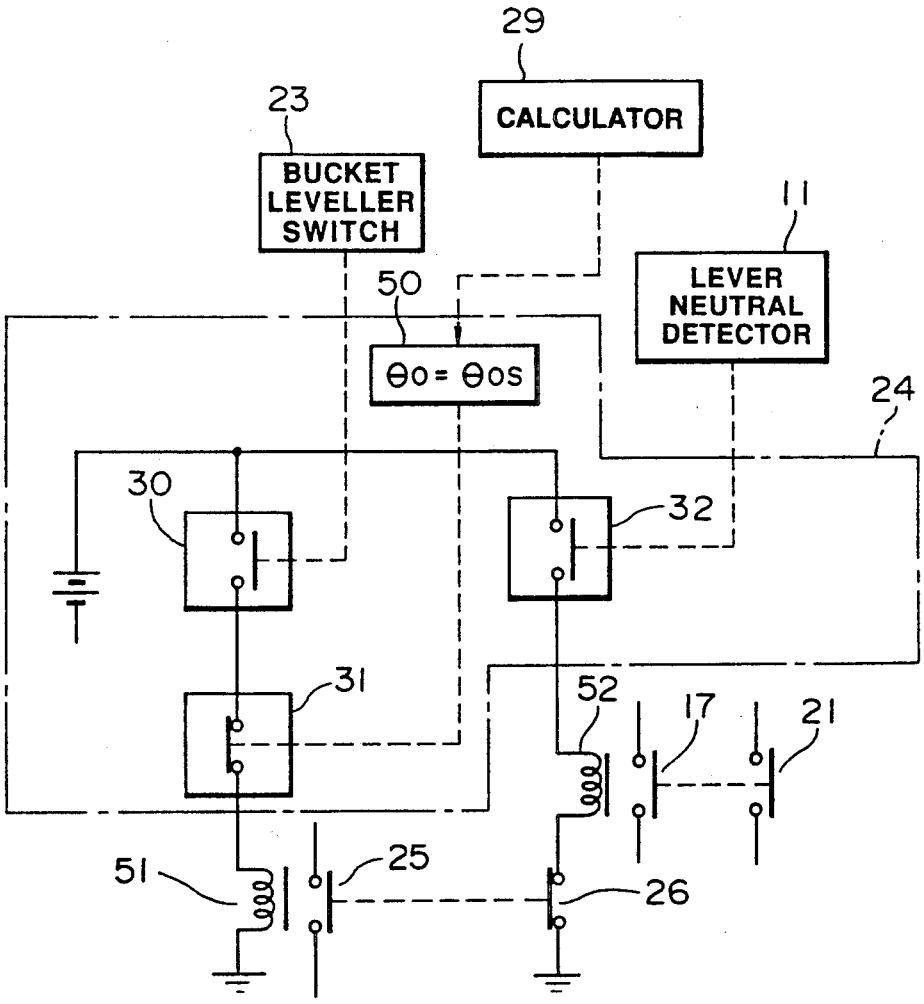
FIG. 6 is a block diagram illustrating by way of example the structure of circuits in a control unit for the apparatus shown in FIG. 5.

FIG. 6 is a circuit diagram illustrating by way of example the inner structure of the control unit 24. The control unit 24 includes a switch 30 of which contact is turned on when the bucket leveler switch 23 is turned on. An output $K_2 \cdot \Delta\theta_{os}$ from the calculator 29 is inputted into a coincidence detecting circuit 50 which detects a coincidence of the true bucket-to-ground angle $\theta_o$ with the preset angle $\theta_{os}$, i.e., $\theta_o=\theta_{os}$ by detecting a condition of $K_2 \cdot \Delta\theta_{os}=0$. In addition, the control unit 24 includes a switch 31 of which contact is shifted from the ON state to an OFF state when the coincidence condition of $\theta_o=\theta_{os}$ is detected by the coincidence circuit 50. When the both switches 30 and 31 are turned on, a solenoid 51 is activated with the result that the switch 25 is turned on and the switch 26 is turned off. It should be added that the switch 25 and the switch 26 always operate to assume their ON/OFF state in a reverse manner to each other.

Accordingly, when it is found that $\theta_o$ is not equal to $\theta_{os}$, the control unit 24 is activated to turn on the switch 25 and turn off the switch 26, but when it is found that $\theta_o$ is equal to $\theta_{os}$, the control unit 24 is reversely activated to turn off the switch and turn off the switch 26.

With such construction, when an operator actuates the bucket leveler switch 23, the switch 30 in the control unit 24 is turned on. Usually, $\theta_o$ does not become equal to $\theta_{os}$ in response to actuation of the bucket leveler switch 23, causing the switch 31 in the control unit 24 to be turned off. In this case, the coil 51 is not activated with the result that the switch 25 is turned on and the switch 26 is turned off. Consequently, the bucket angle correcting signal $K_2 \cdot \theta_{os}$ calculated in the calculator 29 is inputted into the amplifier 22 via the switch 25. The bucket angle correcting signal $K_2 \cdot \Delta\theta_{os}$ is amplified in the amplifier 22 so that a solenoid of the solenoid valve 12 is activated in response to the solenoid valve actuating signal I(q). Thus, the solenoid valve 12 is opened to feed the bucket cylinder with high pressure hydraulic oil so as to allow $\theta_o$ to become equal to $\theta_{os}$, and then the bucket 2 is automatically turned (tilted) until $\theta_o$ becomes equal to $\theta_{os}$.

Thereafter, when $\theta_o$ becomes equal to $\theta_{os}$, this is detected by the coincidence detecting circuit 50, whereby the switch 31 in the control unit 24 is turned on. As a result, the solenoid 51 is activated to turn off the switch 25 and turn on the switch 26. Thus, after $\theta_o$ becomes equal to $\theta_{os}$, angle correcting signal $K_2 \cdot \Delta\theta_{os}$ calculated in the calculator 29 fails to be inputted into the amplifier 22 but an output from the calculator 20 is outputted to the amplifier 22.

Namely, when $\theta_o$ becomes equal to $\theta_{os}$, the switch 26 is turned on, whereby the solenoid 52 is activated as long as the switch 32 in the control unit 24 is turned on, resulting in the switch 17 and the switch 21 being turned on. Incidentally, the switch 32 is turned on when the neutral state of the bucket actuating lever 10 is detected by the lever neutral state detector 11.

As the switch 17 is turned on, a write signal is inputted into the memory 18, whereby an output $\theta_{oM}$ outputted from the bucket-to-ground angle calculator 14 when $\theta_o$ becomes equal to $\theta_{os}$ is stored in the memory 18. On the other hand, the calculator 19 obtains a differential signal $\Delta\theta_o$ $(=\theta_{oM}-\theta_o)$ between the true bucket-to-ground angle $\theta_o$ calculated in the bucket-to-ground angle calculator 14 and the bucket-to-ground angle $\theta_{oM}$ outputted when $\theta_o$ becomes equal to $\theta_{os}$. The calculator 20 calculates a bucket angle correcting signal $K_1 \cdot \Delta\theta_o$ in correspondence to the differential signal $\Delta\theta_o$. Since the switch 21 is turned on after $\theta_o$ becomes equal to $\theta_{os}$, an output $K_1 \cdot \Delta\theta_o$ from the calculator 20 is inputted into the amplifier 22. The input signal $K_1 \cdot \Delta\theta_o$ is converted into a solenoid valve actuating signal I(q) in the amplifier 22 and then the solenoid valve 12 is opened in response to the signal I(q) to feed the bucket cylinder 4 with high pressure hydraulic oil until the bucket-to-ground angle reaches an angle $\theta_{oM}$ stored in the memory 18. Thus, the bucket 2 is held at the preset angle $\theta_{os}$ in the same manner as in the preceding embodiment after $\theta_o$ becomes equal to $\theta_{os}$, irrespective of how far a height of the booms 1 is varied. However, when the bucket actuating lever 10 is displaced to a position other than the neutral position by an operator during the aforementioned controlling operation, the switch 32 is turned off in response to an output from the lever neutral position detector 11, whereby the bucket 2 is displaced not in response to an output from the calculator 20 but in correspondence to displacement of the bucket actuating lever 10.

According to the second embodiment, the bucket 2 is operated in response to the bucket angle correcting signal $K_2 \cdot \Delta\theta_{os}$ until it is stopped at the preset angle $\theta_{os}$ by means of the bucket leveler switch 23, and after it is stopped, it is operated in response to the bucket angle correcting signal $K_1 \cdot \Delta\theta_o$.

Figure 7:
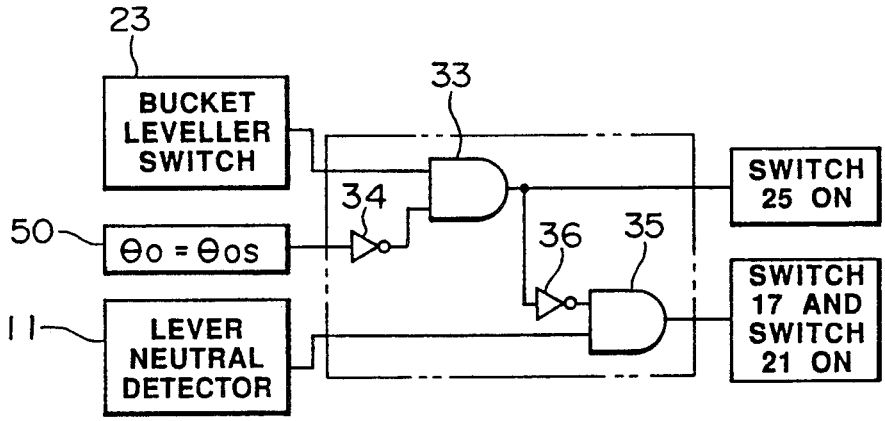
FIG. 7 is a circuit diagram illustrating by way example other circuits in the control unit.

FIG. 7 is a circuit diagram illustrating another modified circuit structure of the control unit 24 which is used for practicing the second embodiment of the present invention, wherein the same function as that of the control unit 24 is realized using logic gates 33 to 36. Specifically, as shown in FIG. 7, arrangement of an AND gate 33 and an inverter 34 makes it possible that the switch 25 is turned on (the switch 26 is turned off) when the bucket leveler switch 23 is turned and $\theta_o$ does not become equal to $\theta_{os}$. Further, arrangement of an AND gate 35 and an inverter 36 makes it possible that the switch 17 and the switch 21 are turned on when an AND condition of the AND gate 33 is not established and the bucket actuating lever 10 is held at the neutral position.

Figure 8:
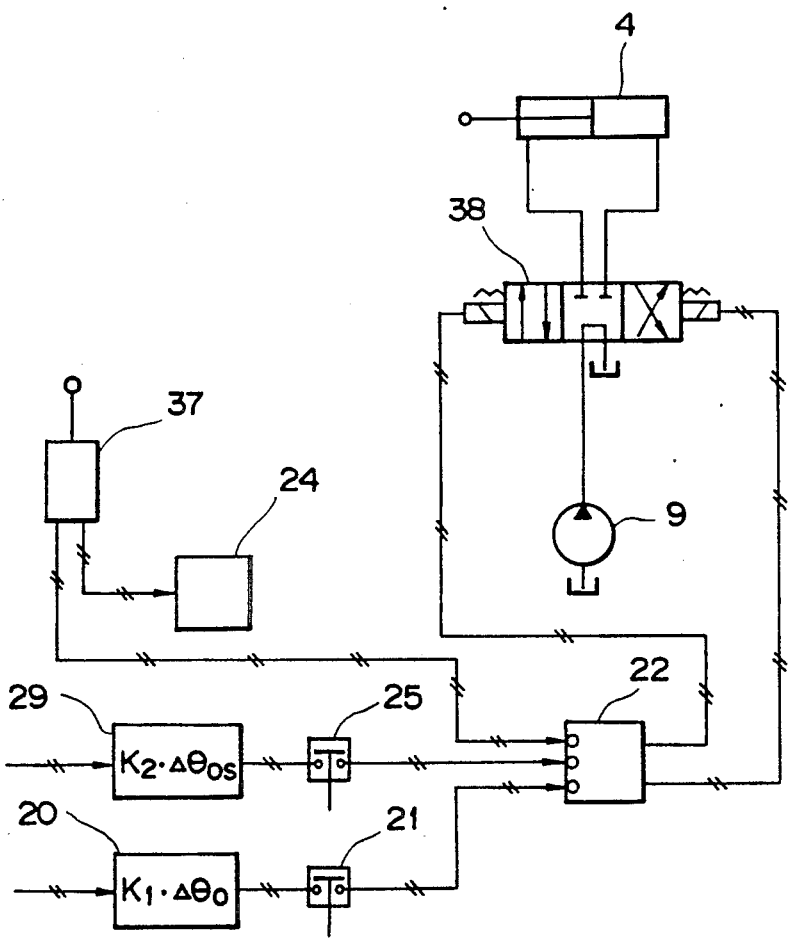
FIG. 8 is a block diagram illustrating by way of example an apparatus modified from that in FIG. 5.

FIG. 8 is a circuit diagram illustrating by way of example the structure of an electrical lever 37 which is substituted for the bucket actuating lever 10 for the apparatus in accordance with the second embodiment. In this case, the bucket cylinder 4 is driven by a single solenoid valve 38. Accordingly, in this case, an output from the electric lever 37, an output $K_1 \cdot \Delta\theta_o$ from the calculator 20 and an output $K_2 \cdot \Delta\theta_{os}$ from the calculator 29 are inputted into the amplifier 22 in which the three inputs are converted into amplified outputs which in turn are inputted into the solenoid of the solenoid valve 38. The output from the electrical lever 37 takes priority over other ones, and when the electrical lever 37 is displaced to a position other than the neutral position, outputs from the calculators 20 and 29 fail to be inputted into the amplifier 22, because the switches 21 and 25 are turned off. A manner of operation of the calculators 20 and 29 is same as in the second embodiment. Namely, when the bucket leveler switch 23 is turned on, a bucket angle correcting signal $K_2 \cdot \Delta\theta_{os}$ is selected and after the bucket 2 assumes a preset angle, a bucket angle correcting signal $K_1 \cdot \Delta\theta_o$ is selected.

According to the embodiments shown in FIGS. 1 and 5, the apparatus is provided with a memory 18 in which a bucket-to-ground angle $\theta_o$ outputted when $\theta_o$ becomes equal to $\theta_{os}$ is stored, and variation of a bucket angle caused by turning movement of the booms 1 is corrected in correspondence to a differential value between the stored value $\theta_{oM}$ and the bucket-to-ground angle $\theta_o$. Alternatively, the apparatus may be modified such that the memory 18 is eliminated and the set value $\theta_{os}$ is inputted into the subtracter 19. In this case, a calculation represented by $\theta_{os}-\theta_o$ is performed in the subtracter 19 and then the bucket angle is corrected depending upon a differential value $\theta_{os}-\theta_o$.

INDUSTRIAL APPLICABILITY

The present invention is advantageously applicable to a vehicle having booms and a bucket or booms and a fork carried thereon such as a shovel loader, a wheel loader or the like vehicle.

We claim:

1. An apparatus for maintaining the attitude of a load carrier on a vehicle, comprising:
   - booms adapted to turn vertically about a fulcrum on a vehicle;
   - said load carrier being turnable about fore ends of said booms;
   - a load carrier actuating lever for actuating said load carrier;
   - a boom actuating lever for actuating said booms;
   - boom angle detecting means for detecting an angle between said booms and the ground;
   - load carrier angle detecting means for detecting an angle between said load carrier and said booms;
   - load-carrier-to-ground angle calculating means for determining an angle of the load carrier relative to a horizontal plane from outputs of said boom angle detecting means and said load carrier angle detecting means;
   - presetting means for presetting an angle at which said load carrier is to be held immovable;

coincidence detecting means for detecting a coincidence of an output of said load-carrier-to-ground angle calculating means with the angle preset by said presetting means;

lever detent mechanism for holding said load carrier actuating lever at a displaced position;

lever detent releasing means, operative when a coincidence signal is output from said coincidence detecting means for releasing said load carrier actuating lever from said displaced position and restoring it to a neutral position;

load carrier neutral position detecting means for detecting that said load carrier actuating lever is held at the neutral position;

memory means for storing a load-carrier-to-ground angle output from said load-carrier-to-ground angle calculating means when a neutral position detection signal is output from said load carrier neutral position detecting means and holding the stored output until a next neutral position detection signal is output from said load carrier neutral position detecting means;

subtracting means for determining a differential value between the value stored in said memory means and the value calculated by said load-carrier-to-ground angle calculating means;

a calculator for calculating a load carrier angle correction signal corresponding to the differential value determined by said subtracting means;

an amplifier for amplifying an output of said calculator to form a load carrier drive signal for driving said load carrier;

switch means for transmitting the output of said calculator to said amplifier only when the neutral position detection signal is output from said load carrier neutral position detecting means;

load carrier driving means for turning said load carrier in response to the load carrier drive signal or a movement of said load carrier actuating lever; and boom driving means for turning said booms in response to a movement of said boom actuating lever, wherein under a semi-automatic state where said booms are driven by said boom actuating lever and said load carrier is driven by the load carrier drive signal, said load carrier is automatically driven until the output of said load-carrier-to-ground angle calculating means coincides with the angle preset by said presetting means as detected by said coincidence detecting means and, after the coincidence is detected by said coincidence detecting means, said load carrier is automatically driven so that the output of said load-carrier-to-ground angle calculating means coincides with the value stored in said memory means.

2. The apparatus according to claim 1, wherein the angle preset by said presetting means is an angle at which a bottom surface of said load carrier is disposed in a horizontal attitude.

3. The apparatus according to claim 1, wherein said load carrier driving means includes a load carrier cylinder for turning said load carrier, and a hydraulic valve for controlling change of hydraulic pressure from a hydraulic pump means to said load carrier cylinder in response to the load carrier drive signal or the movement of said load carrier actuating lever.

* * * * *